United States Patent [19]

Tanabe

[11] Patent Number: 4,463,233

[45] Date of Patent: Jul. 31, 1984

[54] PUSH SWITCH HAVING A DRIVE MEMBER FORMED UNITARILY WITH THE HOUSING

[75] Inventor: Osamu Tanabe, Miyagi, Japan

[73] Assignee: Alps Electric Co., Ltd., Tokyo, Japan

[21] Appl. No.: 431,608

[22] Filed: Sep. 30, 1982

[30] Foreign Application Priority Data

Feb. 10, 1982 [JP] Japan ..... 57-17520[U]

[51] Int. Cl.[3] ..... H01H 3/12

[52] U.S. Cl. ..... 200/159 A; 200/340

[58] Field of Search ..... 200/159 A, 340, 303; 338/92, 93, 198, 199, 200

[56] References Cited

U.S. PATENT DOCUMENTS

| | | | |
|---|---|---|---|
| 3,133,170 | 5/1964 | Nanninga . | |
| 3,182,158 | 5/1965 | Beardow et al. | 200/159 A X |
| 3,940,578 | 2/1976 | Pointon | 200/340 X |
| 4,032,729 | 6/1977 | Koistinen | 200/159 A X |
| 4,051,665 | 10/1977 | Arn | 200/159 R X |
| 4,127,752 | 11/1978 | Lowthorp | 200/340 |
| 4,398,170 | 8/1983 | Nishikawa | 338/198 |

*Primary Examiner*—John W. Shepperd
*Assistant Examiner*—Renee S. Kidorf
*Attorney, Agent, or Firm*—Guy W. Shoup; Gerard F. Dunne

[57] ABSTRACT

A push switch, fixed on the back of a rotary variable resistor, comprises a stationary contact formed on the bottom of an insulating housing part, a movable contact of convex form, and a drive means formed on the end of an arm integrally molded with another part of the insulating housing. The drive means is mounted to the end of the operating shaft, and pushes the central part of the movable contact. Normally, the movable contact during axial movement of the operating shaft does not make contact with the stationary contact, when the operating shaft is pushed, the movable contact however, makes contact with the stationary contact. When pressure on the operating shaft is removed, the movable contact is returned to its original position by the resiliency of the movable contact and the arm.

6 Claims, 6 Drawing Figures

PUSH SWITCH HAVING A DRIVE MEMBER FORMED UNITARILY WITH THE HOUSING

This invention relates to a push switch which operates when an operating shaft of a rotary variable resistor is pushed axially.

The object of this invention is to provide a push switch with a stable operation, and which has a simple structure with a small number of components. According to the invention, a drive means for deforming a movable contact to close the switch is formed unitarily with the housing for the push switch.

Other objects and important features of this invention will be apparent from the following description of preferred embodiments of the invention referring to the drawings wherein:

DESCRIPTION OF PREFERRED EMBODIMENTS

Figure 1A:
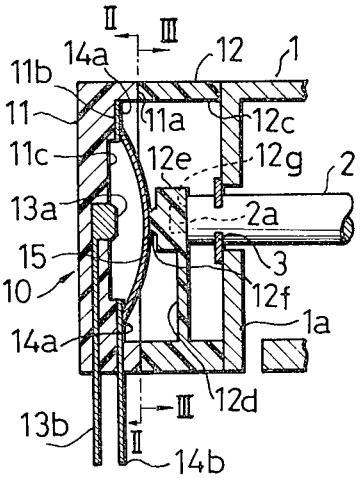
FIGS. 1 (A) and (B) are vertical sectional views showing two states of operation of a push switch 10 of the present invention.

In the embodiment shown in the drawings, the push switch 10 of the present invention is installed at the rear of the housing 1 of a rotary variable resistor having an operating shaft 2 extending rearwardly the housing of the rotary variable resistor. A ring 3 is fixed to said shaft 2 to prevent it from moving fully inwardly of the housing 1 of the rotary variable resistor. This operating shaft 2, when rotated, moves a slider in the variable resistor to set the resistance, and when it is moved in the axial direction operates the push switch 10 of this invention.

Figure 2A:
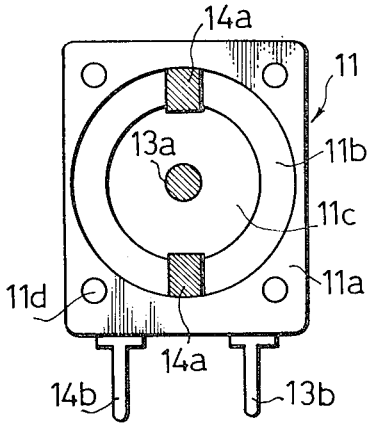
FIG. 2(A) is a plan view of the housing part 11 taken along line II—II of FIG. 1(A)
Figure 2B:
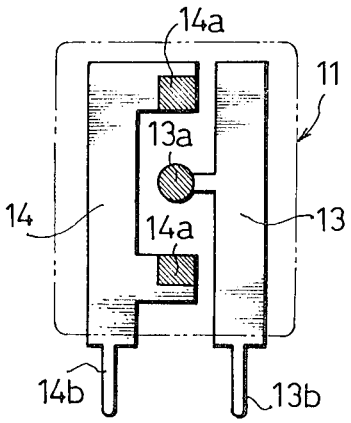
FIG. 2(B) illustrates the conductive plates 13 and 14 embedded in the housing part 11.

The push switch 10 includes two housing parts 11 and 12 made of a synthetic plastic material. The housing part 11 has an annular or ring-shaped surface 11*b* which is recessed from the surface joining it to the other housing part 12, and a central bottom surface 11*c* which is further recessed from said ring-shaped surface 11*b*. Two metal contact plates 13 and 14 are embedded in the housing part 11, by insert molding, as illustrated in FIG. 2(B). Part of a contact plate 13 forms a stationary contact 13*a* and is exposed at the center of the bottom surface 11*c* of the housing part 11. The other end of the contact plate 13 protrudes from the housing part 11, and forms a terminal 13*b*. The other contact plate 14 forms two contacts 14*a*, which are exposed on the ring-shaped surface 11*b* of the housing part 11 and joined together as shown in FIG. 2(B). Similarly, the other end of the contact plate 14 protrudes from the housing part 11, and forms a terminal 14*b*. Holes 11*d* made in the four corners of the joining surface 11*a* of the housing part 11 are positioning holes to position the other housing part 12 in place.

Figure 1B:
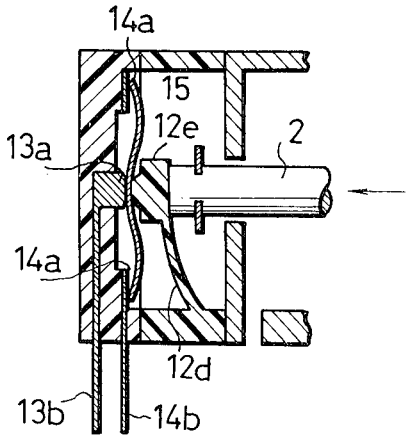

The other housing part 12 has a rectangular form of the same dimensions as the housing part 11. Four pins 12*b* are formed on the surface 12*a* for joining it to the housing part 11, said pins 12*b* are fitted into positioning holes 11*d* on the housing part 11 in order to position the housing parts 11 and 12 in place. A hole 12*c* is formed at the center of the housing part 12. Said hole 12*c* has a internal diameter the same as the external diameter of the ring-shaped surface 11*b* of the housing part 11. A flexible arm 12*d* is formed on the internal wall of the hole 12*c*. Said arm 12*d* is integrally molded with the housing part 12. A drive means 12*e* is formed on the end of the arm 12*d*, and a protrusion 12*f* is formed on the side of the drive means 12*e* facing the housing part 11. A hole 12*g* for fitting the protrusion 2*a* formed on the end of said operation shaft 2 is formed on the other side of the drive means 12*e* as shown in FIG. 1 (A). A movable contact 15 is inserted between the two housings part 11 and 12 when they are assembled. Said movable contact 15 is made of a thin metal sheet to form a circular shape in a plan view, and as FIG. 1 (A) shows, the center of the movable contact 15 is made bulbous. When no external force is exerted on the central portion of the movable contact, said movable contact 15 maintains the bulbous condition as in FIG. 1 (A), and when the center of the movable contact 15 is pressed, the bulbous condition is reversed as shown in FIG. 1 (B). When the external force is removed after the central condition is reversed, the movable contact 15 returns to its original form by its resiliency. The movable contact 15 is so inserted that its circumference always makes contact with the ring-shaped surface 11*b* of the housing part 11, and hence the movable contact 15 always makes contact with the joining contacts 14*a*, and the central part of the movable contact 15 is held against the protrusion 12*f* formed on the drive means 12*e* of the housing part 12.

The action and effect of the push switch of the present invention will be understood from the following description:

When no pressure is applied to the operating shaft 2, the switch is under the condition of FIG. 1 (A). That is to say, the movable contact 15 maintains its convex or bulbous form owing to the resiliency of the movable contact 15 itself, and the arm 12*d* formed in the housing part 12 is in an upright position owing to the resiliency of the arm 12*d* itself. The operating shaft 2 is urgent to the right of the drawing by the resiliency of the movable contact 15 and the arm 12*d*, and also by a restoring spring (which is not shown in the drawing) used in the variable resistor when required, and the ring 3 is in contact with the rear surface 1*a* of the housing 1 of the variable resistor. Under this condition, the movable contact 15 is not in contact with the stationary contact 13*a* and hence the two contact plates 13 and 14 are not electrically connected and the switch is off.

When the operating shaft 2 is pushed to the left in the drawing, the arm 12*d* is deformed and the drive means 12*e* fixed on the end of the operating shaft 2 pushes the central part of the movable contact 15. Therefore, as FIG. 1 (B) shows, the convex or bulbous form of the movable contact 15 is reversed, and the center of the movable contact 15 makes contact with the stationary contact 13*a*. In this condition the contacts 14*a* and the stationary contact 13*a* are electrically connected through the movable contact 15, and the switch is on. When the external force on the operating shaft 2 is removed under the condition of FIG. 1 (B), the operating shaft 2 returns to the condition of FIG. 1 (A) owing to the restoring force of the movable contact 15 and the arm 12*d* (and the restoring force of any supplementary spring).

Figure 3:
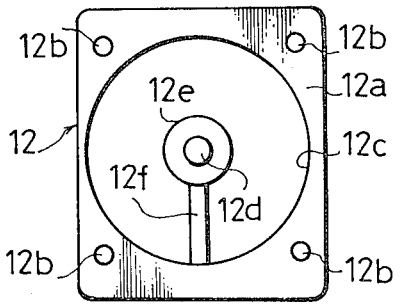
FIG. 3 is a plan view of the housing part 12 taken along line III—III of FIG. 1(A)
Figure 4:
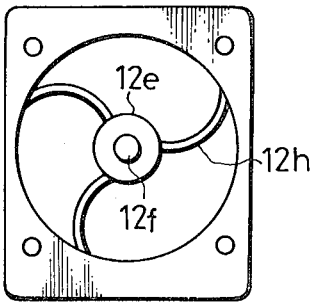
FIG. 4 is another embodiment of the housing part 12.

Although the switch shown in FIG. 3 has one arm 12*d*, a plurality of arms may be radially formed as shown in FIG. 4. In this case, the arms 12*h* are bent so that the drive means 12*e* can move horizontally with axial movement of the operating shaft 2.

According to the present invention, as described above, a flexible arm is unitarily formed with a housing part and a drive means for pushing the movable contact is formed on the end of said arm. Therefore, there is no need to make the drive means separate, and the number of components can be reduced. Also during assembly no process for assembling the drive means is required, shortening the assembly time and facilitating the assembly of small push switches. Furthermore, since the drive means operates under the condition that it is supported by the arm, no failures in operation will occur. If the arm is formed so as to have a constant resiliency, the drive means returns surely by the restoring force of the arm, and the operation of the switch is stabilized and the reliability of the switch is increased.

What is claimed is:

1. A push switch adapted to be mounted rearwardly of a rotary variable resistor having an operating shaft adapted to be rotated to vary the resistance value of said resistor and movable axially to actuate the push switch, said operating shaft having a portion extending rearwardly of said variable resistor, the push switch comprising a housing adapted to be mounted to the rear of said rotary variable resistor and having a plurality of spaced contacts joined electrically together and spaced around peripheral portions of a rear wall portion of said housing, a stationary contact located centrally in the rear wall portion of said housing, a movable contact having a peripheral portion adapted to continually engage said spaced contacts and a bulbous central portion extending away from said stationary contact, and means formed unitarily with said housing for holding an end portion of said operating shaft and engaging the bulbous central portion of said movable contact for pressing said bulbous central portion into engagement with said stationary contact upon movement of said operating shaft axially outwards from the rotary variable resistor.

2. A push switch according to claim 1, said rear wall portion of said housing having an annular recess, said spaced contacts being embedded in said annular recess and the peripheral contact being seated within said annular recess and held therein by the pressure continually applied by said operating shaft and said means formed unitarily with the housing.

3. A push switch according to claim 1, said means formed unitarily with said housing including at least one arm portion extending inwardly from a side wall of said housing, a cup-portion receiving the end of said operating shaft, and a protrusion extending into contact with the bulbous central portion of said movable contact.

4. A push switch according to claim 3, each said arm urging said operating shaft inwardly of the rotary variable resistor.

5. A push switch according to claim 3, including a plurality of said arms.

6. A push switch according to claim 5, each said arm urging said operating shaft inwardly of the rotary variable resistor.

* * * * *